US010697202B2

(12) United States Patent
Geringer et al.

(10) Patent No.: US 10,697,202 B2
(45) Date of Patent: Jun. 30, 2020

(54) ELECTRONIC CATHODE LOCK

(71) Applicant: 1 Adolfo, LLC, Camarillo, CA (US)

(72) Inventors: David A. Geringer, Camarillo, CA (US); Chen Chung Yu, Taichung (TW)

(73) Assignee: Security Door Controls, Camarillo, CA (US)

( * ) Notice: Subject to any disclaimer, the term of this patent is extended or adjusted under 35 U.S.C. 154(b) by 504 days.

(21) Appl. No.: 15/408,239

(22) Filed: Jan. 17, 2017

(65) Prior Publication Data

US 2018/0044945 A1 Feb. 15, 2018

(51) Int. Cl.

| | |
|---|---|
| ***E05B 47/00*** | (2006.01) |
| ***E05B 65/10*** | (2006.01) |
| ***E05B 47/06*** | (2006.01) |

(52) U.S. Cl.

CPC ..... *E05B 47/0603* (2013.01); *E05B 47/0046* (2013.01); *E05B 65/108* (2013.01); *E05B 65/1093* (2013.01); *E05B 47/0004* (2013.01); *Y10T 292/696* (2015.04); *Y10T 292/699* (2015.04)

(58) Field of Classification Search

CPC ..... Y10T 292/696; Y10T 292/699; Y10T 292/1089

See application file for complete search history.

(56) References Cited

U.S. PATENT DOCUMENTS

| | | | | |
|---|---|---|---|---|
| 2,478,434 A * | 8/1949 | Swanson | E05B 65/5238 | 292/175 |
| 2,869,952 A * | 1/1959 | Saunders | E05C 19/02 | 109/63.5 |
| 4,984,835 A * | 1/1991 | Vadacchino | E05B 47/0047 | 292/144 |
| 5,915,766 A * | 6/1999 | Baumeister | B04B 7/06 | 292/201 |
| 6,390,520 B1 * | 5/2002 | Holzer | E05B 47/0046 | 292/341.16 |
| 6,874,830 B2 * | 4/2005 | Bashford | E05B 47/0047 | 292/201 |
| 7,021,684 B2 * | 4/2006 | Orbeta | E05B 47/0046 | 292/201 |
| 7,159,910 B2 * | 1/2007 | Hwang | D06F 39/14 | 292/302 |
| 7,438,335 B1 * | 10/2008 | Uyeda | E05B 47/0046 | 292/341.15 |

(Continued)

*Primary Examiner* — Carlos Lugo

(74) *Attorney, Agent, or Firm* — Ferguson Case Orr Paterson LLP

(57) ABSTRACT

An electronic cathode lock includes a base formed with an opening that is communicated with an accommodating chamber in the base. In the accommodating chamber, two retaining units are provided symmetrically at two sides of the opening, and two driving units are provided corresponding to the retaining units. The two driving units are configured to position the retaining units to overlap the opening, or make the retaining unit move away from the opening. Thereby, the electronic cathode lock limits a latch in the accommodating chamber or makes the latch get out of the accommodating chamber. Such electronic unlocking of the electronic cathode lock is configured to work with a mechanical lock, thereby electronizing the mechanical lock.

19 Claims, 7 Drawing Sheets

(56) References Cited

U.S. PATENT DOCUMENTS

| | | | | |
|---|---|---|---|---|
| 7,540,542 | B2 * | 6/2009 | Geringer | E05B 47/0047 292/341.16 |
| 8,047,585 | B1 * | 11/2011 | Peabody | E05B 47/0046 292/340 |
| 8,096,594 | B2 * | 1/2012 | Uyeda | E05B 47/0046 292/340 |
| 8,454,063 | B2 * | 6/2013 | David | E05B 47/0046 292/340 |
| 8,702,134 | B2 * | 4/2014 | Lesjak | E05B 63/128 292/340 |
| 9,376,835 | B2 * | 6/2016 | Schildwachter | E05B 17/06 |
| 9,617,755 | B2 * | 4/2017 | Peabody | E05B 15/022 |
| 9,702,167 | B2 * | 7/2017 | Liao | E05B 47/0004 |
| 2016/0053511 | A1 * | 2/2016 | Peabody | E05B 15/022 292/341.15 |

* cited by examiner

ELECTRONIC CATHODE LOCK

BACKGROUND OF THE INVENTION

This application claims priority from Taiwan Patent Application No. 105212089 filed with the Taiwan Patent Office on Aug. 10, 2016, the entire content of which is hereby incorporated by reference.

1. Technical Field

The present invention relates to locks, and more particularly to an electronic cathode lock that is operated electrically.

2. Description of Related Art

A conventional mechanical lock, such as a cylindrical lock, a lever lock or a fire door lock, typically comprises two handles and a latch. The handles are provided at two reverse sides of a door plank, and the latch is retractably provided at an edge of the door plank and connected to the handles. When one of the handles is rotated, the latch is driven to retract into the door plank. A doorframe has a lock slot corresponding to the latch. When the door plank is closed to the doorframe, the latch is received in the lock slot. Thereby, when the handle is rotated the mechanical lock has its latch retracting, so as to allow the door plank to be opened.

Despite the trend today toward electronic operation, the conventional mechanical locks can only be operated manually. This fact raises an issue to people working in the art about how to electrically operate mechanical locks. In view of this, the inventor invents the present invention in order to improve the existing mechanical locks.

SUMMARY OF THE INVENTION

The objective of the present invention is to provide an electronic cathode lock, which can work with a mechanical lock, thereby electronizing the mechanical lock.

For achieving the foregoing objective, the disclosed electronic cathode lock comprises: a base, having a lengthwise foundation plate, the foundation plate having long edges thereof defining a major axis and having short edges thereof defining a minor axis, the foundation plate further having a upstanding peripheral wall surrounding a periphery thereof, so that an accommodating chamber is defined on the base, and the peripheral wall having an opening that is formed along the minor axis and communicated with the accommodating chamber; two retaining units, being installed in the accommodating chamber and symmetrically located at two sides of the opening, each said retaining unit including a retaining block, and the retaining block having one end thereof pivotally connected to the foundation plate near the opening and having an opposite end provided with a driven arm that slides along the major axis as the retaining block rotates and has a abutting portion; and two driving units, being installed in the accommodating chamber and corresponding to the retaining units, each said driving unit having an abutting member corresponding to the abutting portion, and the abutting member being connected to a driving member, so that when driven by the driving member, the abutting member is selectively positioned with respect to the abutting portion, so as to hold the driven arm in position to prevent the retaining block from rotation.

The electronic cathode lock of the present invention has the retaining units symmetrically provided at two sides of the opening of the base. When driven by the driving units, the abutting members abut against the driving members and are positioned with respect to the abutting portion, so that the retaining blocks are prevented from pivoting and overlap the opening, thereby retaining a latch in the accommodating chamber. For unlocking, the driving blocks are driven to move away from the abutting member, so that the retaining blocks are pushed by the latch and pivot away from the opening, thereby driving the driven arms to move along the major axis, so that the latch gets out of the accommodating chamber. Such electronic unlocking of the present invention is configured to work with mechanical locks, such as cylindrical locks, lever locks and fire door locks, thereby making a mechanical lock electrically controllable.

DETAILED DESCRIPTION OF THE INVENTION

Figure 1:
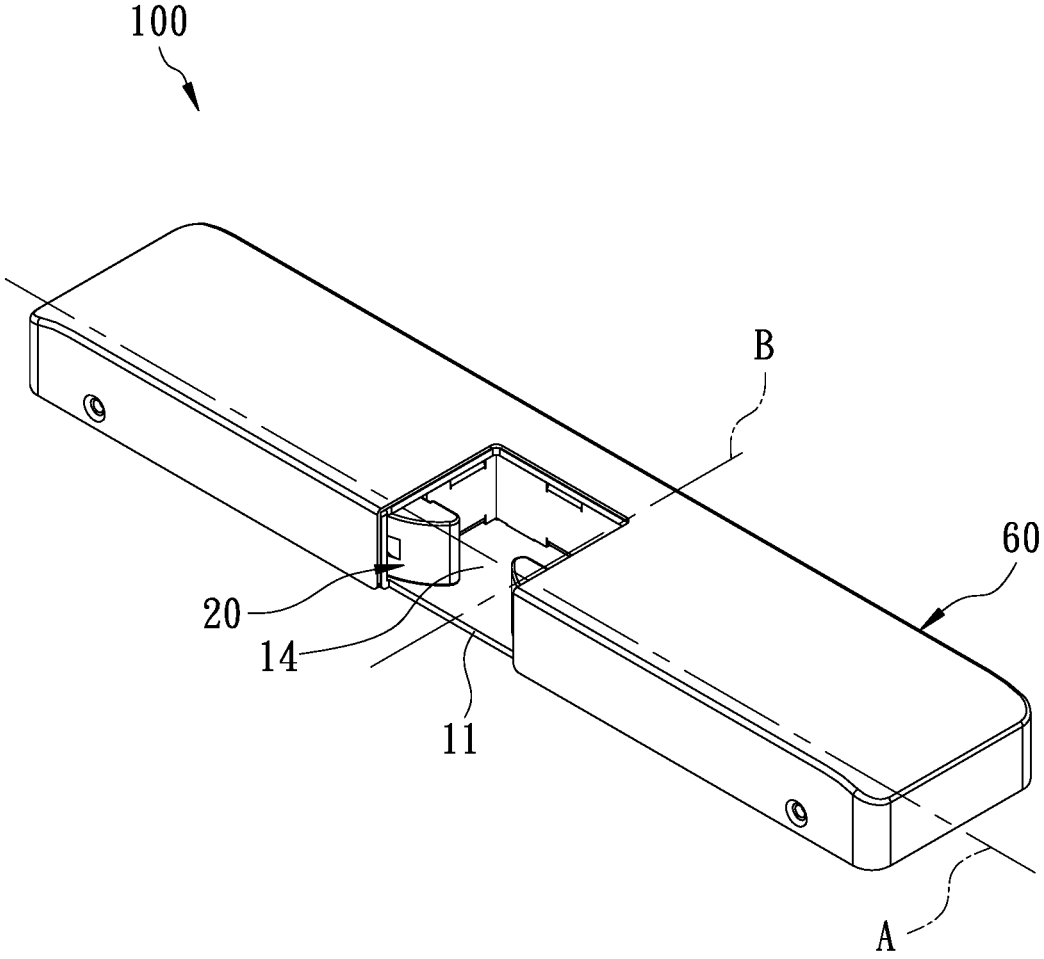
FIG. 1 is a perspective view of one preferred embodiment of the present invention.
Figure 2:
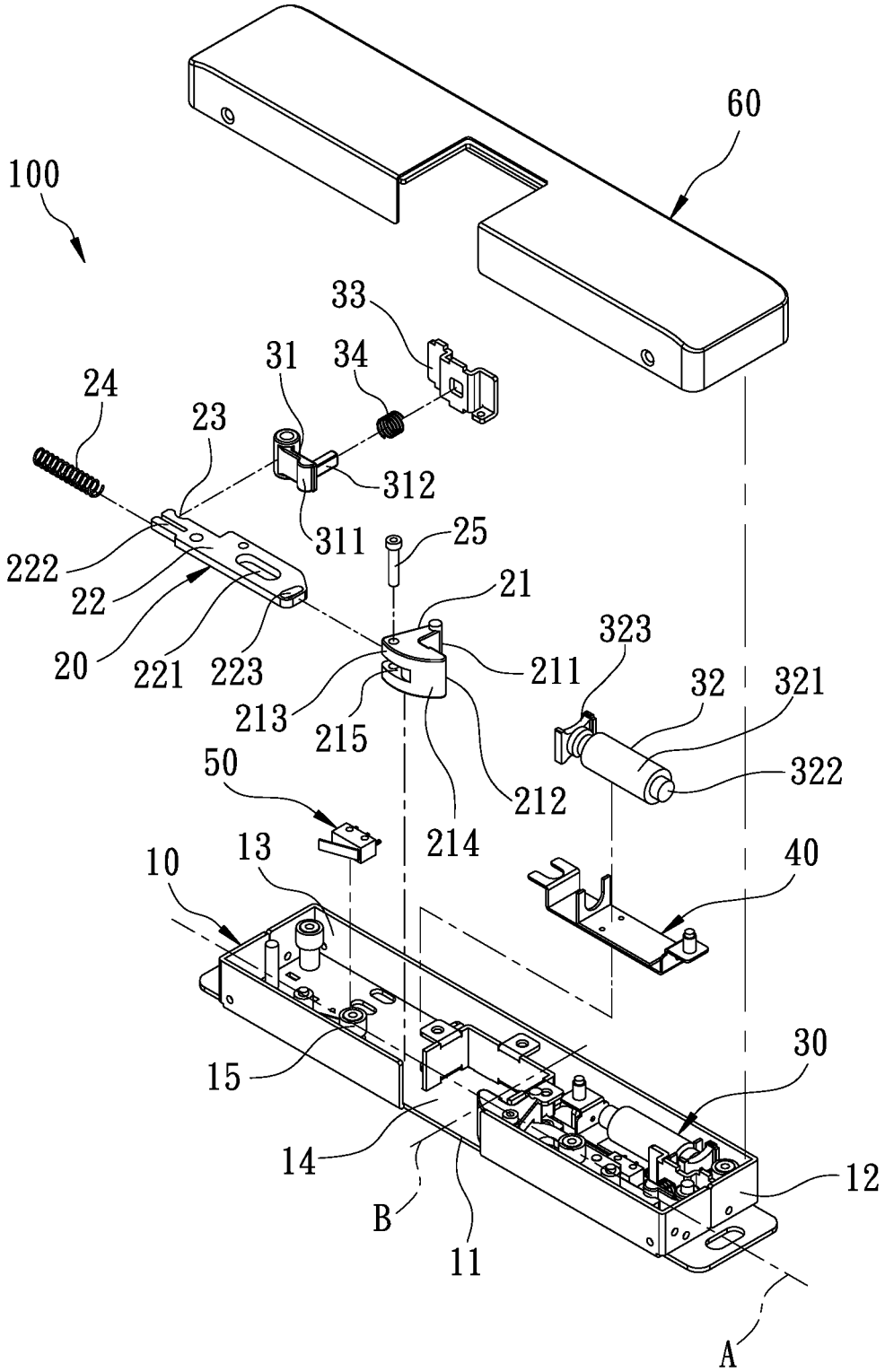
FIG. 2 is an exploded view of the preferred embodiment of the present invention.
Figure 3:
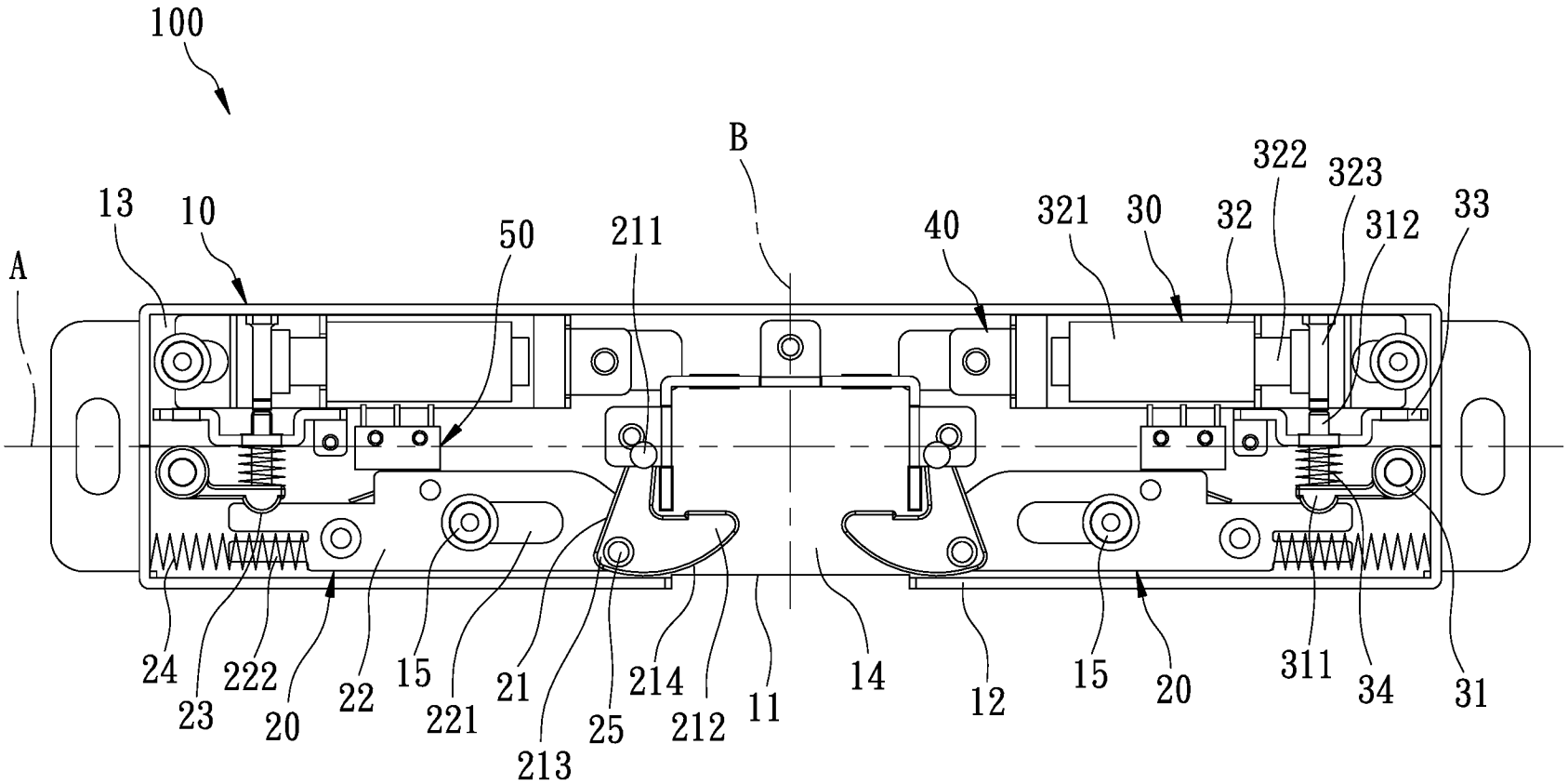
FIG. 3 is a cross-sectional view of the preferred embodiment of the present invention.

An electronic cathode lock 100 according to one preferred embodiment of the present invention is shown in FIG. 1, FIG. 2 and FIG. 3 as a perspective view, an exploded view and a cross-sectional view, respectively. It comprises a base 10, two retaining units 20, two driving units 30, two platforms 40, two contact switches 50 and a casing 60.

The base 10 has a lengthwise foundation plate 11. The foundation plate 11 has its long edges defining a major axis A and has its short edges defining a minor axis B. An upstanding peripheral wall 12 surrounds the foundation plate 11 at its periphery, so that an accommodating chamber 13 is defined in the base 10. The peripheral wall 12 has an opening 14 formed along the minor axis B. The opening 14 is communicated with the accommodating chamber 13. In the present embodiment, the foundation plate 11 has a pair of limiting posts 15 symmetrically raised near two sides of the opening 14.

The two retaining units 20 are installed in the accommodating chamber 13 and symmetrically located at the two sides of the opening 14. The retaining unit 20 comprises a retaining block 21. The retaining block 21 has its one end pivotally connected to the foundation plate 11 near the opening 14 and has its opposite end provided with a driven arm 22. The driven arm 22 slides along the major axis A as the retaining block 21 rotates. The driven arm 22 has an abutting portion 23. In the present embodiment, the driven arm 22 has a lengthwise limiting hole 221 corresponding to the limiting post 15. The limiting hole 221 has its length parallel to the major axis A, so that the limiting post 15 is allowed to pass through the limiting hole 221 and thereby limit the driven arm 22 to only move along the major axis A.

The driven arm 22 has its free end provided with two linking blocks 222 separately arranged along the major axis A. One of the linking blocks 222 has the abutting portion 23. The abutting portion 23 has a curved indentation and the other linking block 222 has a first spring 24 mounted there around. The first spring 24 has its free end springingly abutting against the peripheral wall 12. The retaining block 21 is in a roughly V shape and has a pivotal end 211, a stopping end 212, and an elbow portion 213. The pivotal end 211 is pivotally connected to the foundation plate 11. The stopping end 212 has a cambered surface 214 and selectively overlaps the opening 14. The pivotal end 211 has a recess 215 corresponding to the driven arm 22. The driven arm 22 is configured to be received in the recess 215 and has a slot 223 formed near the retaining block 21. A pivot 25 passes through the retaining block 21 and the slot 223, so as to limit the retaining block 21 to pivot without leaving the slot 223.

The two driving units 30 are installed in the accommodating chamber 13 so that they correspond to the retaining units 20, respectively. The driving unit 30 has an abutting member 31 corresponding to the abutting portion 23. The abutting member 31 is connected to a driving member 32. When driven by the driving member 32, the abutting member 31 is selectively positioned with respect to the abutting portion 23, so as to place the driven arm 22 in a position where the retaining block 21 is prevented by the driven arm 22 from rotation. In the present embodiment, each of the driving units 30 further comprises an upright plate 33. The upright plates 33 are each set on the foundation plate 11 and located between a corresponding set of the driving member 32 and the abutting member 31. The abutting member 31 is structurally a plate. The abutting member 31 has its one end pivotally connected to the foundation plate 11 and has its opposite end provided with a salient 311 corresponding to the curved indentation. The abutting member 31 further has a shaft 312 corresponding to the driving member 32. The shaft 312 passes through the upright plate 33 and selectively abuts against the driving member 32.

A second spring 34 is mounted around the shaft 312 with its two ends springingly abutting against the abutting member 31 and the upright plate 33, respectively. In addition, each of the driving members 32 further comprises a solenoid valve 321. The solenoid valve 321 has an extension rod 322. The extension rod 322 has its one end provided with a driving block 323. The solenoid valve 321 controls the extension rod 322 to drive the driving block 323 to move along the major axis A and to be stopped by the abutting member 31. The abutting member 31 abuts against the driving block 323 and is positioned with respect to the abutting portion 23, so that the retaining block 21 is prevented by the driven arm 22 from rotation and overlaps the opening 14, or controls the extension rod 322 to drive the driving block 323 away from the abutting member 31, thereby allowing the driven arms 22 to move along the major axis A and allowing the retaining blocks 21 to pivot away from the opening 14.

Each of the two platforms 40 is installed between the corresponding set of the driving member 32 and the foundation plate 11. The driving member 32 is fixed to the platform 40. In addition, the platform 40 drives the driving member 32 to move along the major axis A so as to positionally fine-tune the driving member 32.

The two contact switches 50 are installed in the accommodating chamber 13 and correspond to the retaining units 20, respectively. When the retaining blocks 21 pivot away from the opening 14, the driven arms 22 contact the contact switches 50, respectively, so as to send a message indicating that the retaining blocks 21 are away from the opening 14 to a central control system.

The casing 60 covers the base 10 at its side opposite to the foundation plate 11.

For further illustrating the structural features, technical means and expected effects of the present invention, the following description is directed to the use of the present invention.

Figure 4:
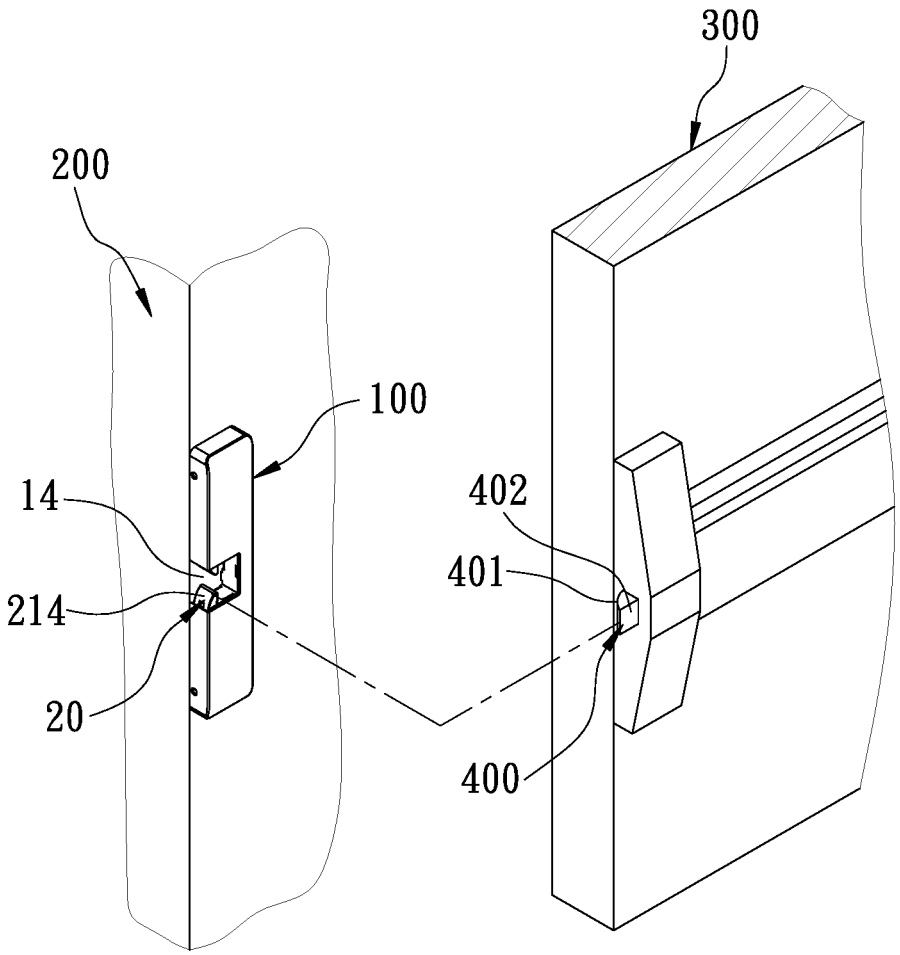
FIG. 4 through FIG. 6 show operation of the preferred embodiment of the present invention.
Figure 5:
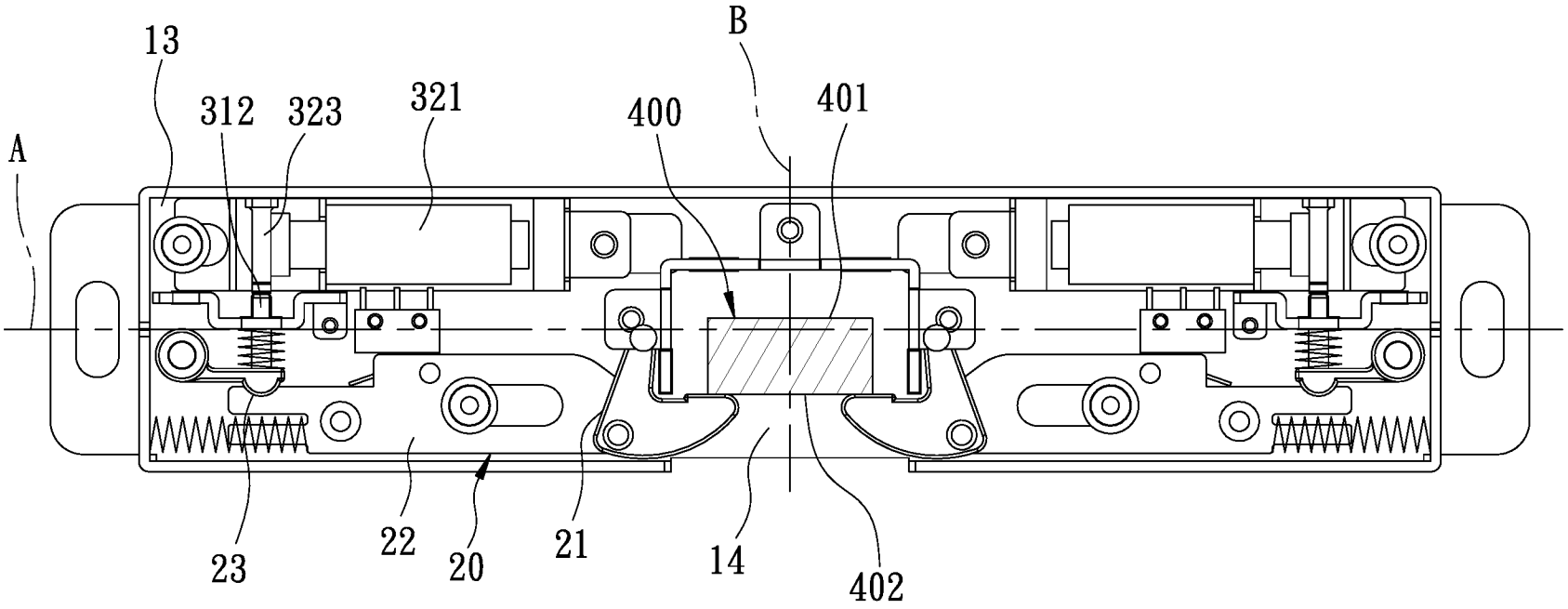
Figure 6:
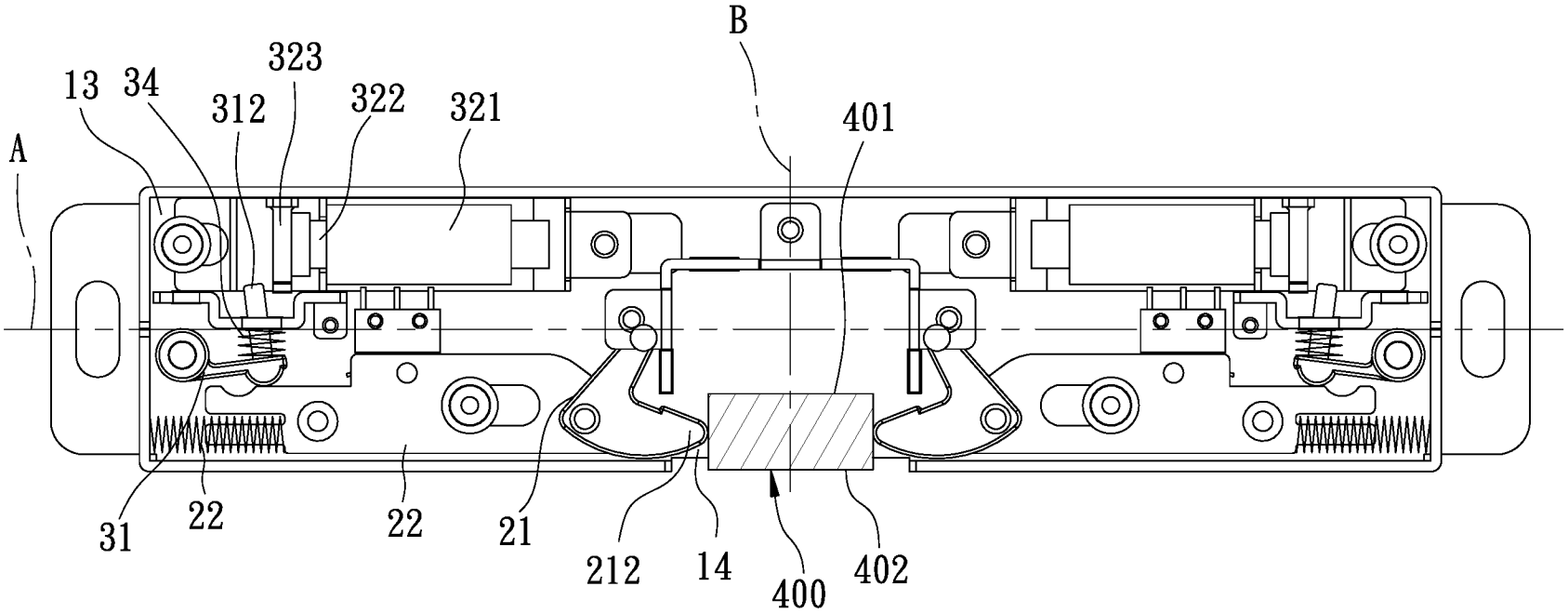

Referring to FIG. 4 through FIG. 6, the electronic cathode lock 100 is installed on a doorframe 200. The doorframe 200 works with a matching door plank 300. The door plank 300 has one edge provided with a latch 400 corresponding to the opening 14. The latch 400 has its side facing the opening 14 formed as a cambered surface 401, and has its side opposite to the cambered surface 401 formed as a plane surface 402. The latch 400 is configured to retract into the door plank 300. Normally, as shown in FIG. 5 and FIG. 6, the solenoid valves 321 are not energized, and the driving blocks 323 correspond to the shafts 312, respectively, while the latch 400 is aligned with the opening 14 and pushes the retaining blocks 21, so that the abutting portions 23 of the driven arms 22 push the abutting members 31, thereby making the shafts 312 abut against the driving blocks 323 and preventing the retaining units 20 from moving. At this time, the cambered surface 401 of the latch 400 guides the latch 400 to retract into the door plank 300. When the latch 400 passes through the retaining blocks 21 and then projects, the latch 400 is limited in the accommodating chamber 13, and the plane surface 402 abuts against the retaining blocks 21. When unlocking is desired, as shown in FIG. 6, the solenoid valves 321 are energized and control the extension rods 322 to drive the driving block 323 to move along the major axis A away from the shafts 312. The plane surface 402 of the latch 400 abuts against the retaining blocks 21 so as to make the retaining blocks 21 pivot, thereby driving the driven arms 22 to move along the major axis A and compress the first springs 24. As a result, the abutting members 31 are pushed to rotate, so that the shafts 321 move and compress the second springs 34, thereby making the stopping ends 212 of the retaining blocks 21 move away from the opening 14, which allows the latch 400 to get out of the accommodating chamber 13.

Figure 7:
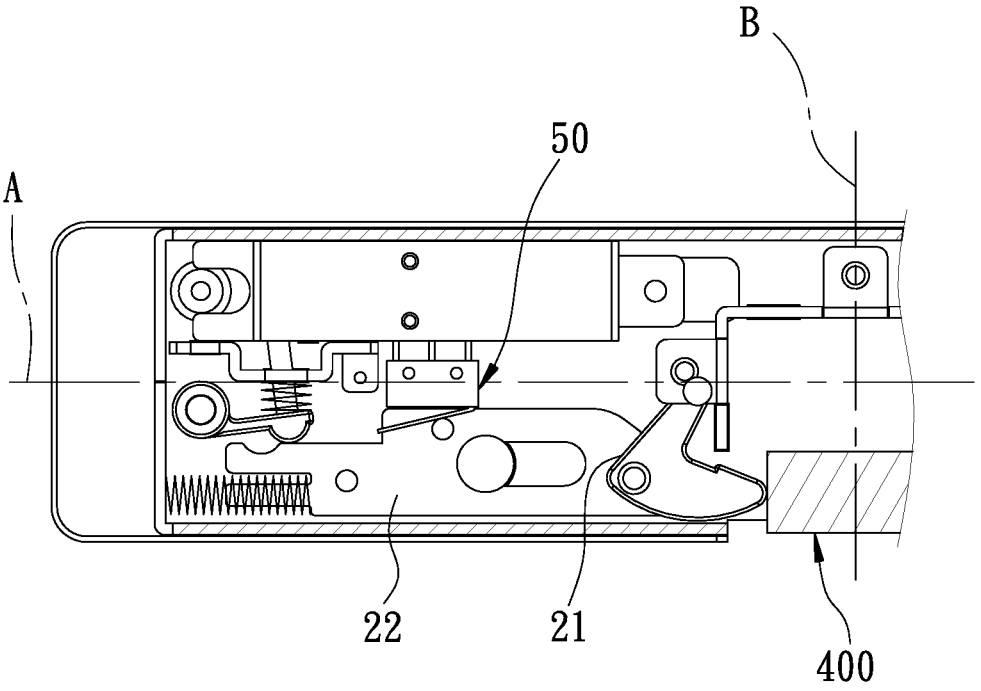
FIG. 7 is a partial, cross-sectional view of the preferred embodiment of the present invention.

Referring to FIG. 6 and FIG. 7, when moving along the major axis A, the driven arms 22 contact the contact switches 50, respectively, so as to send a message of unlocking to a central control system (not shown).

Thereby, with the retaining units 20 symmetrically provided at two sides of the opening 14 of the base 10, when driven by the driving units 30, the shafts 321 of the abutting members 31 abut against the driving blocks 323, respectively, and get positioned at the abutting portions 23, thereby preventing the retaining blocks 21 from pivoting and making them overlap the opening 14, so as to retain the latch 400 in the accommodating chamber. For unlocking, the solenoid valves 321 are energized to control the extension rods 322 to drive the driving blocks 323 to move along the major axis A away from the shafts 312. At this time, the retaining blocks 21 are pushed by the latch 400 and pivot away from the opening 14, thereby driving the driven arms 22 to move along the major axis A, so that the latch 400 gets out of the accommodating chamber 13 and unlocking is done. Such electronic unlocking of the present invention is configured to work with mechanical locks, such as cylindrical locks, lever locks and fire door locks, thereby electronizing a mechanical lock.

The features and expected effects of the present invention are summarized as below.

The electronic cathode lock 100 of the present invention has the retaining units 20 symmetrically provided at two sides of the opening 14 of the base 10. When driven by the driving units 30, the shafts 321 of the abutting members 31 abut against the driving blocks 323, respectively, and are positioned with respect to the abutting portion 23, so that the retaining blocks 21 are prevented from pivoting and overlap the opening 14, thereby retaining the latch 400 in the accommodating chamber. For unlocking, the solenoid valves 321 are energized to control the extension rods 322 to drive the driving blocks 323 to move along the major axis A away from the shafts 312. At this time, the retaining blocks 21 are pushed by the latch 400 and pivot away from the opening 14, thereby driving the driven arms 22 to move along the major axis A, so that the latch 400 gets out of the accommodating chamber 13 and unlocking is done. Such electronic unlocking of the present invention is configured to work with mechanical locks, such as cylindrical locks, lever locks and fire door locks, thereby electronizing a mechanical lock.

To sum up, the present invention shows great inventive steps in its class and no disclosure of identical structures has not been seen in any technical materials and literature related to this art. For these reasons, the present invention is worthy to be patented and thus the application is filed according to law.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. An electronic cathode lock, comprising:

a base having an accommodating chamber, said base having an opening to the accommodating chamber;

two retaining units mounted in said accommodating chamber at opposing sides of the opening, each said retaining unit including a retaining block having one end pivotally connected to the base near the opening and connected to a respective driven arm that slides in said base as the retaining block rotates;

two driving units, each mounted in the accommodating chamber and each corresponding to a respective one of said retaining units, each said driving unit electrically operable so as to hold its said driven arm in position to prevent the retaining block from rotation and a sensing unit for sensing one or more driven arm when the retaining blocks pivot away from said opening, said sensing unit sending a message to a central control system indicating that each said retaining blocks are away from said opening, wherein said base comprises a lengthwise foundation plate, the foundation plate having long edges thereof defining a major axis and having short edges thereof defining a minor axis, the foundation plate further having an upstanding peripheral wall surrounding a periphery thereof, wherein the retaining block is in a roughly V shape and has a pivotal end, a stopping end and an elbow portion, the pivotal end being pivotally connected to the foundation plate, the stopping end having a cambered surface and being configured to selectively overlap the opening, the pivotal end having a recess corresponding to the driven arm, the driven arm being configured to be received in the recess and having a slot near the retaining block, so that a pivot passing through the retaining block and the slot limits the retaining block to pivot without leaving the slot.

2. The electronic cathode lock of claim 1, wherein each said driving unit comprises an abutting member corresponding to an abutting portion, and the abutting member being connected to a driving member, so that when driven by the driving member, the abutting member is selectively positioned with respect to the abutting portion to prevent the retaining block from rotation.

3. The electronic cathode lock of claim 1, wherein said opening is formed though said peripheral wall along said minor axis and communicated with said accommodating chamber.

4. The electronic cathode of claim 1, wherein said retaining units are symmetrically located at two sides of said opening.

5. The electronic cathode of claim 1, wherein each said retaining block having one end thereof pivotally connected to the foundation plate.

6. The electronic cathode of claim 1, wherein each said driven arm slides along the major axis as the retaining block rotates.

7. The electronic cathode lock of claim 1, wherein the foundation plate has a pair of limiting posts symmetrically raised near the two sides of the opening, the driven arm having a lengthwise limiting hole corresponding to the limiting post, and the limiting hole having its length parallel to the major axis, so that the limiting post is allowed to pass through the limiting hole and thereby limit the driven arm to only move along the major axis.

8. The electronic cathode lock of claim 1, wherein the driven arm has a free end thereof provided with two linking blocks separately arranged along the major axis, one of the linking blocks having an abutting portion, the abutting portion being structurally a curved indentation, the other linking block having a first spring mounted there around, and the first spring having a free end thereof springingly abutting against the peripheral wall.

9. The electronic cathode lock of claim 1, wherein each said driving unit further comprising an upright plate, the upright plates being each set on the foundation plate and located between a corresponding set of a driving member and an abutting member, the abutting member being structurally a plate, the abutting member having one end thereof pivotally connected to the foundation plate and having an opposite end thereof provided with a salient, the abutting member further having a shaft corresponding to the driving member, the shaft passing through the upright plate and selectively abutting against the driving member, and a second spring being mounted around the shaft with two ends thereof springingly abutting against the abutting member and the upright plate, respectively.

10. The electronic cathode lock of claim 1, wherein each said driving member further comprises a solenoid valve, the solenoid valve having an extension rod, the extension rod having one end thereof provided with a driving block, and the solenoid valve controlling the extension rod to drive the driving block to move along the major axis and to be stopped by the abutting member, so that the abutting member abuts against the driving block and is positioned with respect to the abutting portion, thereby having the retaining block getting prevented by the driven arm from rotation and overlapping the opening, or controlling the extension rod to drive the driving block away from the abutting member, which in turn allows the driven arms to move along the major axis and allows the retaining blocks to pivot away from the opening.

11. The electronic cathode lock of claim 1, further comprising two platforms each being installed between the corresponding set of the driving member and the foundation plate, the driving member being fixed to the platform, and the platform driving the driving member to move along the major axis so as to positionally fine-tune the driving member.

12. The electronic cathode lock of claim 1, further comprising two contact switches that are installed in the accommodating chamber and correspond to the retaining units, respectively, so that when the retaining blocks pivot away from the opening, the driven arms contact the contact switches, respectively, thereby sending a message indicating that the retaining blocks are away from the opening to a central control system.

13. The electronic cathode lock of claim 1, further comprising a casing that covers the base at a side thereof opposite to the foundation plate.

14. The electronic cathode lock of claim 1, further comprising:

two platforms;

two contact switches; and a casing.

15. An electronic cathode lock, comprising:

a base, having a major axis and a minor axis, and an opening that is formed along the minor axis;

two retaining blocks mounted at opposing sides of the opening, and each pivotally connected said base to cooperate with said opening and each connected to a driven arm that slides along the major axis as its respective said retaining block pivots; and two driving units mounted to said base and each of which is operable so as to hold a respective said driven arm in position to prevent said retaining block from pivoting and;

a sensing unit for sensing one or more driven arm when the retaining blocks pivot away from said opening, said sensing unit sending a message to a central control system indicating that each said retaining blocks are away from said opening, wherein said base comprises a lengthwise foundation plate, the foundation plate having long edges thereof defining a major axis and having short edges thereof defining a minor axis, the foundation plate further having an upstanding peripheral wall surrounding a periphery thereof, wherein the driven arm has a free end thereof provided with two linking blocks separately arranged along the major axis, one of the linking blocks having an abutting portion, the abutting portion being structurally a curved indentation, the other linking block having a first spring mounted there around, and the first spring having a free end thereof springingly abutting against the peripheral wall.

16. The electronic cathode lock of claim 15, wherein said driving units are electrically operable.

17. The electronic cathode lock of claim 15, wherein said base comprises a foundation further having an upstanding peripheral wall surrounding a periphery thereof, and said opening is formed in said peripheral wall.

18. The electronic cathode lock of claim 15, wherein each said driving unit comprises an abutting member corresponding to the abutting portion, and the abutting member being connected to a driving member, so that when driven by the driving member, the abutting member is selectively positioned with respect to the abutting portion.

19. An electronic cathode lock, comprising:

a base having an opening to an accommodating chamber;

two retaining units mounted to said base and symmetrically located at two sides of said opening, each said retaining unit including a retaining block pivotally connected to said base to at least partially limit said opening to said accommodating chamber, each retaining block also connected to a driven arm that slides along the major axis as the retaining block pivots;

two driving units, being installed in the accommodating chamber and corresponding to the retaining units, each said driving unit having an abutting member corresponding to an abutting portion, and the abutting member being connected to a driving member, so that when driven by the driving member, the abutting member is selectively positioned with respect to the abutting portion, so as to hold the driven arm in position to prevent the retaining block from pivoting and;

a sensing unit for sensing one or more driven arm when the retaining blocks pivot away from said opening, said sensing unit sending a message to a central control system indicating that each said retaining blocks are away from said opening, wherein said base comprises a lengthwise foundation plate, the foundation plate having long edges thereof defining a major axis and having short edges thereof defining a minor axis, the foundation plate further having an upstanding peripheral wall surrounding a periphery thereof, wherein each said driving unit further comprising an upright plate, the upright plates being each set on the foundation plate and located between a corresponding set of the driving member and the abutting member, the abutting member being structurally a plate, the abutting member having one end thereof pivotally connected to the foundation plate and having an opposite end thereof provided with a salient, the abutting member further having a shaft corresponding to the driving member, the shaft passing through the upright plate and selectively abutting against the driving member, and a second spring being mounted around the shaft with two ends thereof springingly abutting against the abutting member and the upright plate, respectively.

* * * * *